US006530965B2

(12) United States Patent
Warchol

(10) Patent No.: US 6,530,965 B2
(45) Date of Patent: Mar. 11, 2003

(54) METHOD OF CONVERTING HEAVY OIL RESIDUUM TO A USEFUL FUEL

(75) Inventor: Edward J. Warchol, Calgary (CA)

(73) Assignee: Colt Engineering Corporation, Calgary (CA)

( * ) Notice: Subject to any disclaimer, the term of this patent is extended or adjusted under 35 U.S.C. 154(b) by 0 days.

(21) Appl. No.: 09/842,839

(22) Filed: Apr. 27, 2001

(65) Prior Publication Data

US 2002/0157304 A1 Oct. 31, 2002

(51) Int. Cl.[7] ..... C10L 1/32

(52) U.S. Cl. ..... 44/301; 516/38; 208/22; 208/29

(58) Field of Search ..... 44/301; 516/38; 208/22, 39

(56) References Cited

U.S. PATENT DOCUMENTS 5,551,956 A 9/1996 Moriyama et al. ..... 44/301
6,001,886 A * 12/1999 Shirodkar ..... 516/51
6,036,473 A 3/2000 Ichinose et al. ..... 431/4
6,183,629 B1 * 2/2001 Bando et al. ..... 208/426

* cited by examiner

*Primary Examiner*—Cephia D. Toomer

(74) *Attorney, Agent, or Firm*—Paul Sharpe; Ogilvy Renault

(57) ABSTRACT

A method for enabling the use of heavy oil residuum by conversion to a useful product. The method, in one embodiment, involves the use of a heavy oil residuum which is substantially non flowable. The viscosity of the residuum is reduced and subsequently mixed with water such that the mixing is high shear mixing. This results in the formation of an emulsion of predispersed residuum in an aqueous matrix. The emulsion is formed such that the aqueous matrix is in a size distribution suitable for use as a combustible fuel.

18 Claims, 2 Drawing Sheets

METHOD OF CONVERTING HEAVY OIL RESIDUUM TO A USEFUL FUEL

FIELD OF THE INVENTION

The present invention relates to a method for enabling the use of heavy oil residuum to a useful product and more particularly the present invention relates to a method for converting such residuum to a fuel which can be used for power generation and steam production for heavy oil recovery, and as a direct process heating source.

BACKGROUND OF THE INVENTION

In view of escalating fuel prices and particularly natural gas prices, there has been a resurgence in the need to consider less costly fuel options.

One of the limitations in the fuel generation art is that the art has not thoroughly considered the possibility of using materials which are generally not considered as fuels, but have the possibility of conversion to useful fuel. One such material that is useful is residuum and in particular, heavy oil residuum. Such materials present numerous difficulties in that the viscosity is quite high to the point that the material almost comprises a solid and thus handling and conversion to a form suitable for use as a combustible fuel have presented difficulties. It is known in the chemical engineering field that droplet size range is important to produce a fuel which will burn in a host of boiler types and not present problems in terms of boiler selection, sufficient carbon burnout or violation of existing flue gas opacity standards.

It has been proposed previously to convert other materials to a fuel, however, such proposals have not proved viable, since droplet size could not be produced in a size distribution sufficient to be efficiently burned in a wide variety of boilers or other combustion devices.

In U.S. Pat. No. 5,551,956, issued to Moriyama et al., Sep. 3, 1996, there is disclosed a super heavy oil emulsion fuel and method for generating deteriorated oil and water super heavy oil emulsion fuel. The fuel is indicated to have a relatively low viscosity and adequate long-term stability and comprises in an emulsified state 100 parts by weight of a super heavy oil, 25 to 80 parts by weight water and 0.02 to 5 parts by weight of the non-ionic surfactant. This reference teaches a useful fuel, however, there is no recognition of formulating an emulsion which creates a particle size sufficient for use as an energy source in a boiler for use in power generation and steam recovery for heavy oil recovery.

Ichinose et al., in U.S. Pat. No. 6,036,473, issued Mar. 14, 2000, teaches a heavy oil emulsified fuel combustion apparatus. This reference is primarily focused on the apparatus and does not go into any real detail with respect to a fuel or conversion process for converting residuum to a useful combustible fuel.

It would be desirable if there were a method to formulate a combustible fuel in a desirable size range for the emulsified particles to be used in any type of boiler for use as an energy source. The present invention speaks to the issues in the industry and presents a particle having a droplet size necessary to achieve more efficient burning.

SUMMARY OF THE INVENTION

One object of the present invention is to provide a method for converting heavy oil residuum to a combustible fuel, comprising the steps of:

providing a source of heavy oil residuum having a viscosity such that the residuum is substantially non flowable at ambient conditions;

reducing the viscosity of the residuum to facilitate flow thereof;

providing a mixing means;

providing a source of water; mixing the water and reduced viscosity residuum in the mixing means; and forming, in the mixing means, an emulsion of predispersed residuum in an aqueous matrix in a size distribution suitable for use as a combustible fuel.

Advantageously, the present invention ensures a relatively flat size distribution where the emulsified particles fall within the size distribution of 0.5 microns to 50 microns. In this size distribution, the choice for boiler selection is fairly broad whereas particles in a size distribution of greater than 50 microns present complications in that boiler selection is restricted generally to only fluid bed combustion technology. It also becomes difficult to obtain sufficient carbon burnout with a large size droplet and presents complications of flue gas opacity.

It has been found that by providing a process for generating a droplet within the size distribution indicated above, there is a significant increase in the technology options employable to the user, including the use of fluid bed boilers, conventional radiant boilers and conventional once through steam generators, commonly employed in the heavy oil recovery operations.

In accordance with a further object of one embodiment of the present invention there is provided a method for converting heavy oil residuum to a combustible fuel, comprising the steps of: providing a source of raw residuum from a source of bottoms from heavy oil treatment or fractionation, said residuum having a viscosity such that said residuum is substantially non flowable; reducing said viscosity of said residuum with a liquid diluent to facilitate flow of said residuum; providing a mixing means; providing a source of water; mixing said water and reduced viscosity residuum in said mixing means; and forming, in said mixing means, an emulsion of predispersed residuum in an aqueous matrix in a particle size distribution of between 0.5 microns and 50 microns suitable for use as a combustible fuel.

It has been found that the control of the viscosity of the residuum is important so that the material can be mixed in a mixer capable of formulating a micro-sized emulsion. A suitable mixer that has been employed to effect the present invention can consist of a variety of suitable mixers manufactured by the Kenics Company among others. The company produces a helical mixing arrangement which is useful for particularly efficient mixing. Other suitable devices capable of formulating the emulsion include collation mills which may be ganged in series or parallel, backward centrifugal and gear pumps positioned in series inter alia. The type of mixer will be apparent to one skilled in the art. The choice of the mixer will be selected to result in entrainment of the heavy oil residuum within a liquid (aqueous) matrix such that a particle distribution is formed in the range of 0.5 microns to 50 microns.

According to a further object of one embodiment of the present invention there is provided: a process for converting heavy oil residuum to a combustible fuel, comprising of:

providing a source of heavy oil; pretreating said oil to remove entrained water;

fractioning said oil into fractions at least one of which is heavy oil residuum; reducing said viscosity of said residuum to facilitate flow thereof;

providing a mixing means;

providing a source of water;

mixing said water and reduced viscosity residuum in said mixing means; and forming, in said mixing means, an emulsion of predispersed residuum in an aqueous matrix in a size distribution suitable for use as a combustible fuel.

Having thus described the invention, reference will now be made to the accompanying drawing illustrating a preferred embodiment.

BRIEF DESCRIPTION OF THE DRAWINGS

Similar numerals employed in the specification denote similar elements.

DETAILED DESCRIPTION OF THE PREFERRED EMBODIMENTS

Figure 1:
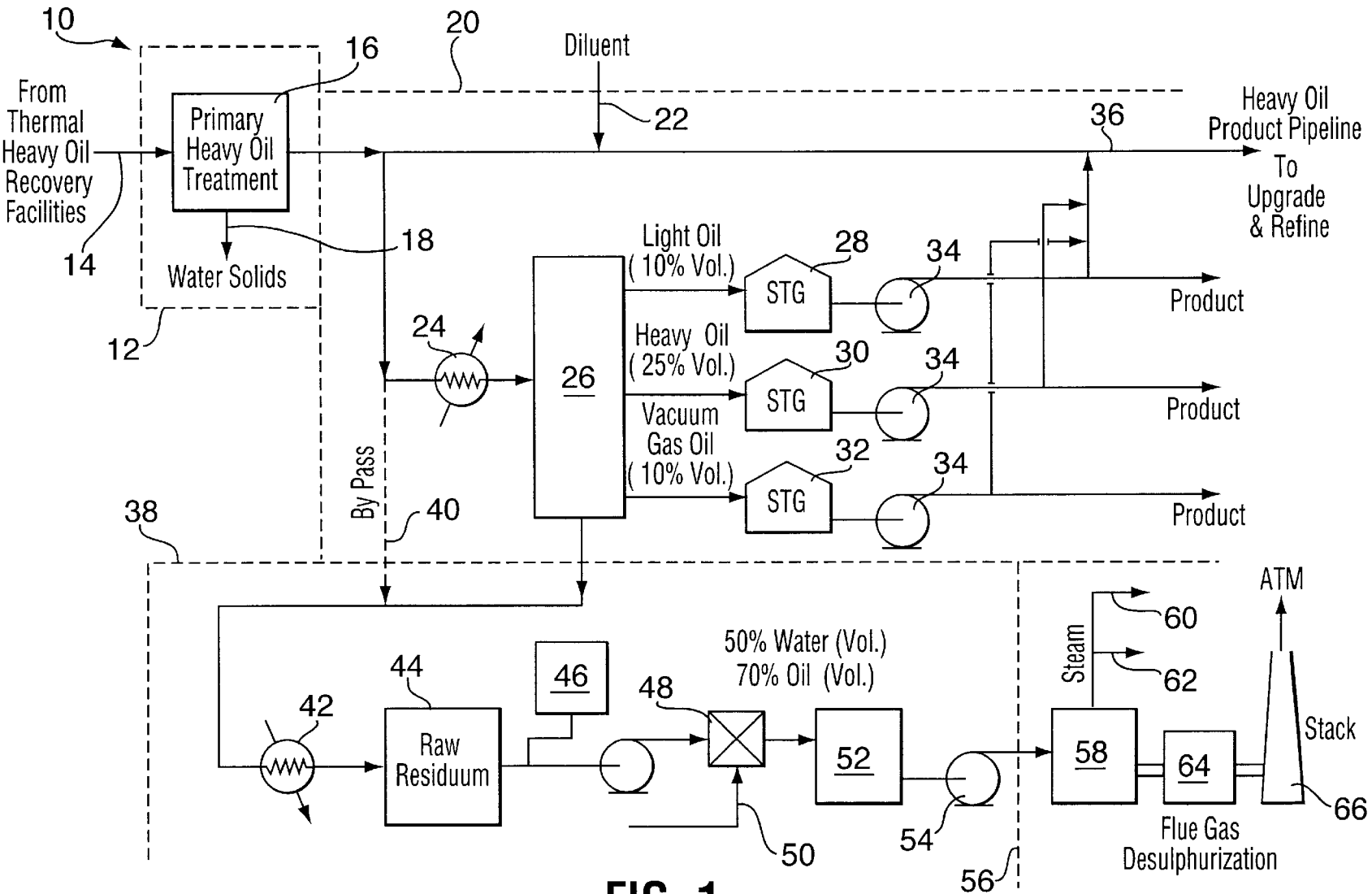
FIG. 1 is a schematic illustration of a process for converting heavy oil residuum into a fuel according to one embodiment of the invention.

Referring now to FIG. 1, shown is one embodiment of the present invention.

In FIG. 1, reference numeral 10 globally denotes the overall process In the area bounded by the dash lines and denoted numeral 12, there is schematically illustrated a commercially practiced heavy oil separation facility which primarily results in the removal of water and solid contaminants, from the oil recovered. A source of heavy oil 14 undergoes dewatering in a known process denoted by numeral 16 with the water and solids being removed from the heavy oil, generally denoted by numeral 18. Once this has been done, the next step, which is known in the art, is shown in the area bounded by the dash line indicated by numeral 20. This represents a common oil fractionating process which results in distillation of the various fractions of oil by temperature sensitivity. In this process, a suitable diluent 22 can be introduced into the circuit to reduce the viscosity of the oil. The material is then heated by a heater 24 and introduced into a fractionating unit 26 where the fractions are distilled based on their characteristic distillation temperatures. The light oils are stored in storage vessel 28, while the heavy oils in vessel 30 and the gas oil mixture are stored in vessel 32. The light oil is in a concentration of about 10% by volume, with the heavy oil approximating 25% by oil and the gas oil mixture approximately 10% by volume. The material is then pumped by pumps 34 and left as a product or introduced to a pipeline 36 for further processing (upgrading and refining).

Turning to the area bounded by chain line and indicated by numeral 38, shown is a schematic representation of the process in accordance with one embodiment of the present invention. The material from the heavy oil water recovery may be subjected to the heavy oil treatment as indicated here and previously and subsequently transported to the process denoted by numeral 38 by way of a bypass line 40 which introduces pre-treated heavy oil directly into the circuit for emulsification. The material may be cooled by a medium 42 to a temperature for storage and maintain suitable handling viscosity or fed directly to the emulsion preparation unit denoted by number 48. The raw residuum, denoted by numeral 44, at this point is essentially a non-flowable mass if allowed to cool to ambient conditions. Suitable surfactant is introduced to the material stored in vessel 46, the material may be pumped into an emulsification preparation unit, globally denoted by numeral 48. In the emulsification unit, water or steam is added via line 50. In the emulsification unit, intimate high sheer mixing is performed which may be done by the mixers described herein previously. The desirable result from the mixing is to provide a particle distribution in a flat sized distribution range of 0.5 microns to 50 microns. It is desirable also to have a water content in each particle of between 25% by weight and 40% by weight. The quantity of water and surfactant to the raw residual will depend upon the final product considerations such as stability of the emulsion over long periods of time or short periods of time as well as other factors related to the burning of the material. It has also been found that in the process according to the present invention, the residual need not be in an aqueous phase, desirable results have been obtained where the immiscible material has been in a solid or liquid phase.

Product analysis of the final emulsion has demonstrated that the material is capable of producing 4,000 to 10,000 Btu/lb as compared to the raw residuum having between 12,000 and 14,000 Btu/lb or greater; (15,000 to 20,000 Btu/lb,) depending on the degree of cut in the fractionation unit and quality of feedback. Accordingly, approximately 70% retention of energy is achieved for a material that was previously not considered viable for use as a fuel.

One of the more attractive advantages of the process is the fact that the process is reversible; the emulsion can be de-emulsified readily to convert the material back to its original form. This has positive ramifications for further use or different uses entirely.

In terms of suitable surfactants and other chemicals which may be added to the raw residuum, the following are representative of useful examples of such compounds nonionic surfactants, anionic surfactants, cationic surfactants inter alia.

Once the product has been emulsified, the final product contains as indicated above, generally 70% by oil weight and 30% by water weight in a substantially spherical particle. This material may be then stored in a vessel 52 or pumped for further processing by pump 54 to the processing stage broadly denoted by numeral 56 shown in dash line. In this process the emulsion may be burned in a combustion device 58 with liberated steam going to further use such as a power generation or process heating, broadly denoted by numeral 60 or a storage in a reservoir 62.

Figure 2:
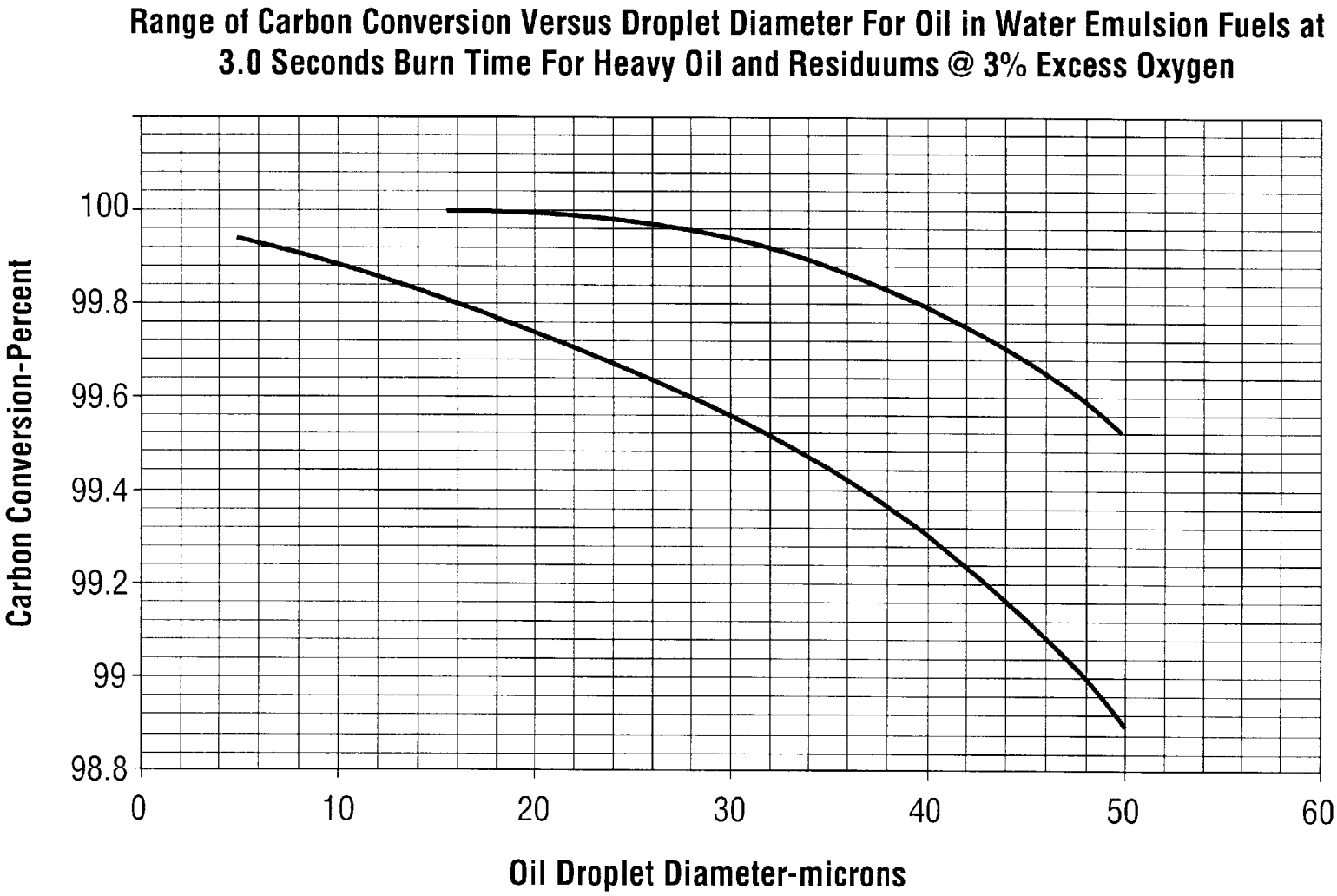
FIG. 2 is a graphical representation of carbon burnout as a function of droplet size.

FIG. 2 illustrates the effect of droplet size relation to carbon burnout. The present invention, by providing a droplet size in the range specified between 5 $\mu$m and 50 $\mu$m, maximizes on the relationship for the emulsified fuel.

Due to the high sulfur content of the material as stated herein previously, the combustion products maybe passed into a flue gas desulfurization unit 64 prior to being passed through stack 66 to the atmosphere. This desulfurization can also be performed in the combustion chamber, for boilers such as fluid bed type.

Heavy oil residuum has been discussed in detail here, however, it will be apparent that any residuum may be processed by the process 38. Variations will be appreciated by those skilled in the art.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A method for converting heavy oil residuum to a combustible fuel, comprising the steps of:

providing a source of heavy oil residuum having a viscosity such that said residuum is substantially non flowable;

reducing said viscosity of said residuum with a liquid diluent to facilitate flow thereof;

providing a mixing means;

providing a source of water;

mixing said water and reduced viscosity residuum in said mixing means; and forming, in said mixing means, an emulsion of predispersed residuum in an aqueous matrix in a size distribution suitable for use as a combustible fuel.

2. The method as set forth in claim 1, wherein said size distribution is between 0.5 microns and 50 microns.

3. The method as set forth in claim 2, wherein said size distribution is between 5 microns and 50 microns.

4. The method as set forth in claim 1, wherein said predispersed fuel is in a liquid state.

5. The method as set forth in claim 1, wherein said predispersed fuel is in a solid state.

6. The method as set forth in claim 1, wherein said aqueous matrix and predispersed fuel therein comprises a substantially spherical particle.

7. The method as set forth in claim 6, wherein said aqueous matrix contains between 25% and 40% by weight water.

8. The method as set forth in claim 1, further including the step of introducing said emulsion into a combustion means for combustion as a fuel.

9. A method for converting heavy oil residuum to a combustible fuel, comprising the steps of:

providing a source of raw residuum from a source of bottoms from heavy oil treatment or fractionation, said residuum having a viscosity such that said residuum is substantially non flowable;

reducing said viscosity of said residuum with a liquid diluent to facilitate flow of said residuum;

providing a mixing means;

providing a source of water;

mixing said water and reduced viscosity residuum in said mixing means; and forming, in said mixing means, an emulsion of predispersed residuum in an aqueous matrix in a particle size distribution of between 0.5 microns and 50 microns suitable for use as a combustible fuel.

10. The method as set forth in claim 9, further including the step of cooling said residuum prior to reducing said viscosity.

11. The method as set forth in claim 9, wherein each said aqueous matrix comprises between 25% and 40% by weight water.

12. The method as set forth in claim 9, wherein said predispersed residuum is liquid.

13. The method as set forth in claim 9, wherein said predispersed residuum is solid.

14. A process for converting heavy oil residuum to a combustible fuel, comprising of:

providing a source of heavy oil;

pre-treating said oil to remove entrained water;

fractioning said oil into fractions, at least one of which is heavy oil residuum;

reducing said viscosity of said residuum with a liquid diluent to facilitate flow thereof;

providing a mixing means;

providing a source of water;

mixing said water and reduced viscosity residuum in said mixing means; and forming, in said mixing means, an emulsion of predispersed residuum in an aqueous matrix in a size distribution suitable for use as a combustible fuel.

15. The method as set forth in claim 14, wherein said size distribution is between 0.5 microns and 50 microns.

16. The method as set forth in claim 15, wherein said size distribution is between 5 microns and 50 microns.

17. The method as set forth in claim 15, wherein said predispersed fuel is in a liquid state.

18. The method as set forth in claim 14, wherein said predispersed fuel is in a solid state.

* * * * *